US011772936B1

(12) United States Patent
Singh

(10) Patent No.: US 11,772,936 B1
(45) Date of Patent: Oct. 3, 2023

(54) PORTABLE TRANSPORT APPARATUS

(71) Applicant: Tino Singh, Ft Lee, VA (US)

(72) Inventor: Tino Singh, Ft Lee, VA (US)

( * ) Notice: Subject to any disclaimer, the term of this patent is extended or adjusted under 35 U.S.C. 154(b) by 9 days.

(21) Appl. No.: 17/676,922

(22) Filed: Feb. 22, 2022

(51) Int. Cl.

| | |
|---|---|
| ***B66B 9/193*** | (2006.01) |
| ***B66D 1/12*** | (2006.01) |
| ***B66B 1/30*** | (2006.01) |
| ***B66B 9/06*** | (2006.01) |
| ***B66B 11/04*** | (2006.01) |
| ***B66D 1/46*** | (2006.01) |

(52) U.S. Cl.
CPC ..... *B66B 9/193* (2013.01); *B66B 1/30* (2013.01); *B66B 9/06* (2013.01); *B66B 11/043* (2013.01); *B66D 1/12* (2013.01); *B66D 1/46* (2013.01)

(58) Field of Classification Search
CPC ..... B66B 9/187; B66B 9/193; B66B 9/16; B66B 9/06
See application file for complete search history.

(56) References Cited

U.S. PATENT DOCUMENTS

| | | | | |
|---|---|---|---|---|
| 3,115,211 | A * | 12/1963 | Ostrander, Jr. | E06C 7/12 187/241 |
| 4,183,423 | A * | 1/1980 | Lewis | B66B 9/16 187/244 |
| 4,512,440 | A * | 4/1985 | Bixby | E06C 1/381 187/241 |
| 5,193,650 | A | 3/1993 | Kent, Jr. | |
| 6,929,443 | B1 | 8/2005 | Nellis | |
| D540,503 | S | 4/2007 | Tsang | |
| 7,681,691 | B1 | 3/2010 | Miller | |
| 9,382,101 | B2 | 7/2016 | Friedrich | |
| 10,532,782 | B2 | 1/2020 | Lu | |
| 2008/0093176 | A1* | 4/2008 | Rosenthal | B66B 9/083 187/241 |
| 2015/0196439 | A1 | 7/2015 | Surenovich | |
| 2015/0273250 | A1* | 10/2015 | Bina | B66B 9/187 182/8 |

FOREIGN PATENT DOCUMENTS

| | | | | |
|---|---|---|---|---|
| GB | 2116943 | A * | 10/1983 | B66B 9/16 |
| WO | 2012048944 | | 4/2012 | |

* cited by examiner

*Primary Examiner* — Diem M Tran

(57) ABSTRACT

The portable transport apparatus is a mechanical structure. The portable transport apparatus forms a ramp. The portable transport apparatus is a portable structure. The portable transport apparatus is a temporary structure. The portable transport apparatus transports cargo between a first horizontal surface and a second horizontal surface. By unaligned is meant that the elevation of the first horizontal surface is different from the elevation of the second horizontal surface. The portable transport apparatus is an electrically powered device. The portable transport apparatus converts electrical energy into mechanical energy used to change the elevation of the cargo between the first horizontal surface and the second horizontal surface.

17 Claims, 5 Drawing Sheets

PORTABLE TRANSPORT APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mobile lifts specially adapted for use with inclined lift ways. (B66B9/193)

SUMMARY OF INVENTION

The portable transport apparatus is a mechanical structure. The portable transport apparatus forms a ramp. The portable transport apparatus is a portable structure. The portable transport apparatus is a temporary structure. The portable transport apparatus transports cargo between a first horizontal surface and a second horizontal surface. By unaligned is meant that the elevation of the first horizontal surface is different from the elevation of the second horizontal surface. The portable transport apparatus is an electrically powered device. The portable transport apparatus converts electrical energy into mechanical energy used to change the elevation of the cargo between the first horizontal surface and the second horizontal surface.

These together with additional objects, features and advantages of the portable transport apparatus will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable transport apparatus in detail, it is to be understood that the portable transport apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable transport apparatus.

It is therefore important that the claims be regarded as including such equivalent construction insofar as they do not depart from the spirit and scope of the portable transport apparatus. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
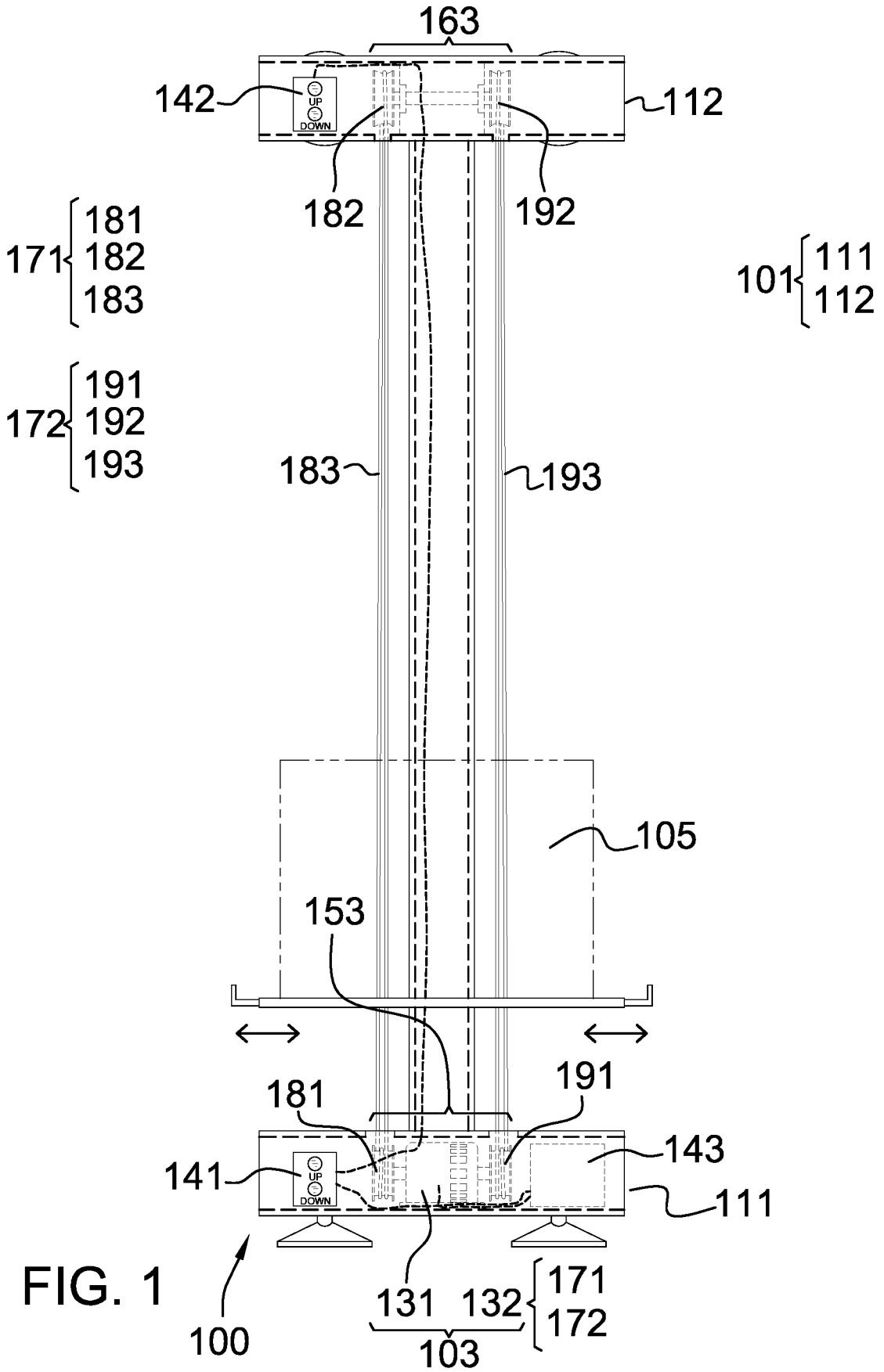
FIG. 1 is a front view of an embodiment of the disclosure.
Figure 2:
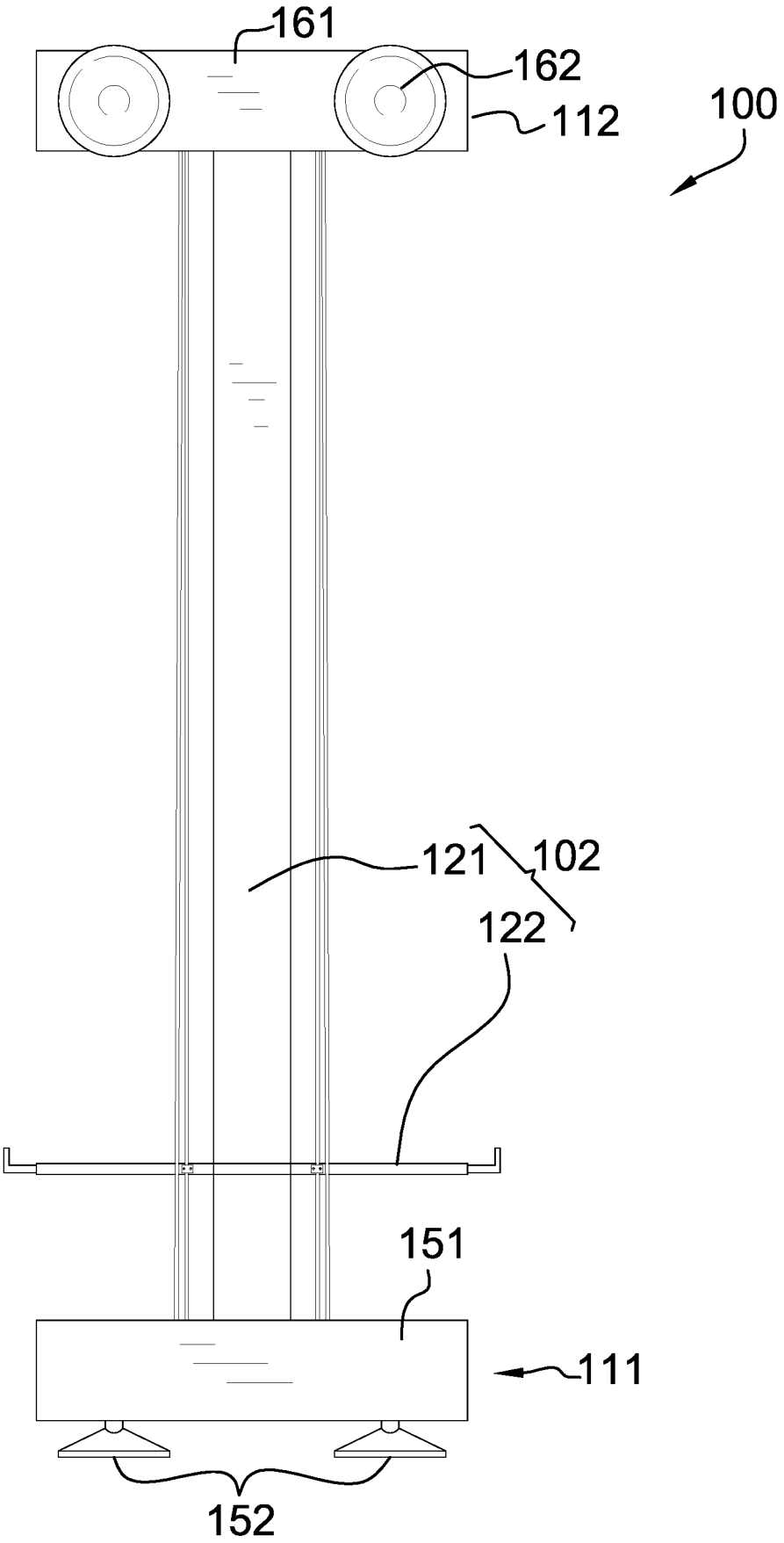
FIG. 2 is a rear view of an embodiment of the disclosure.
Figure 3:
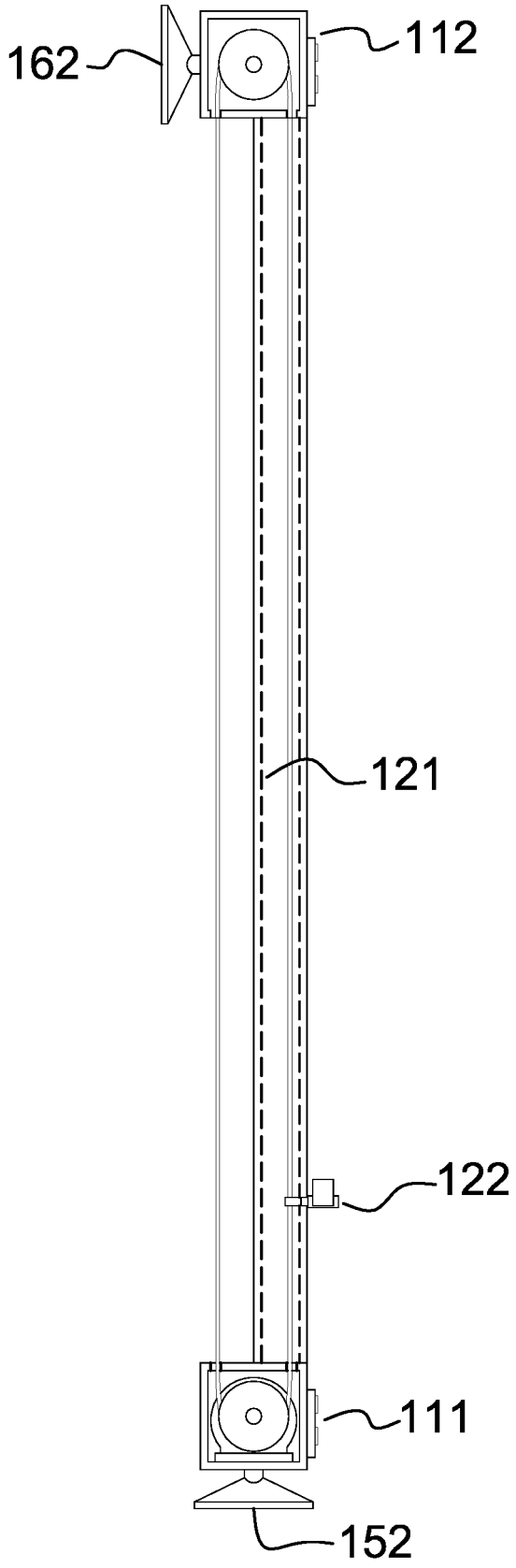
FIG. 3 is a side view of an embodiment of the disclosure.
Figure 4:
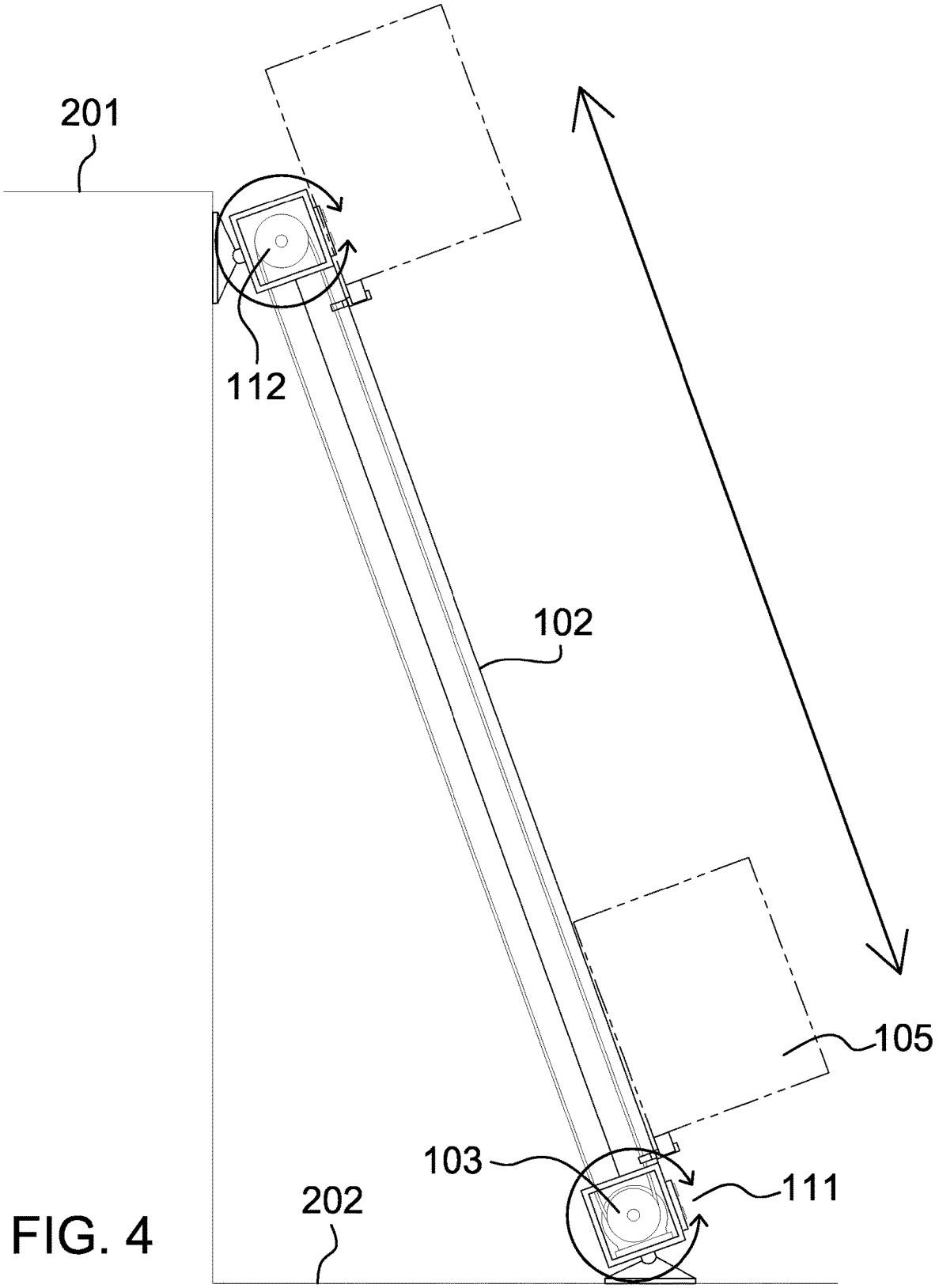
FIG. 4 is an in-use view of an embodiment of the disclosure.
Figure 5:
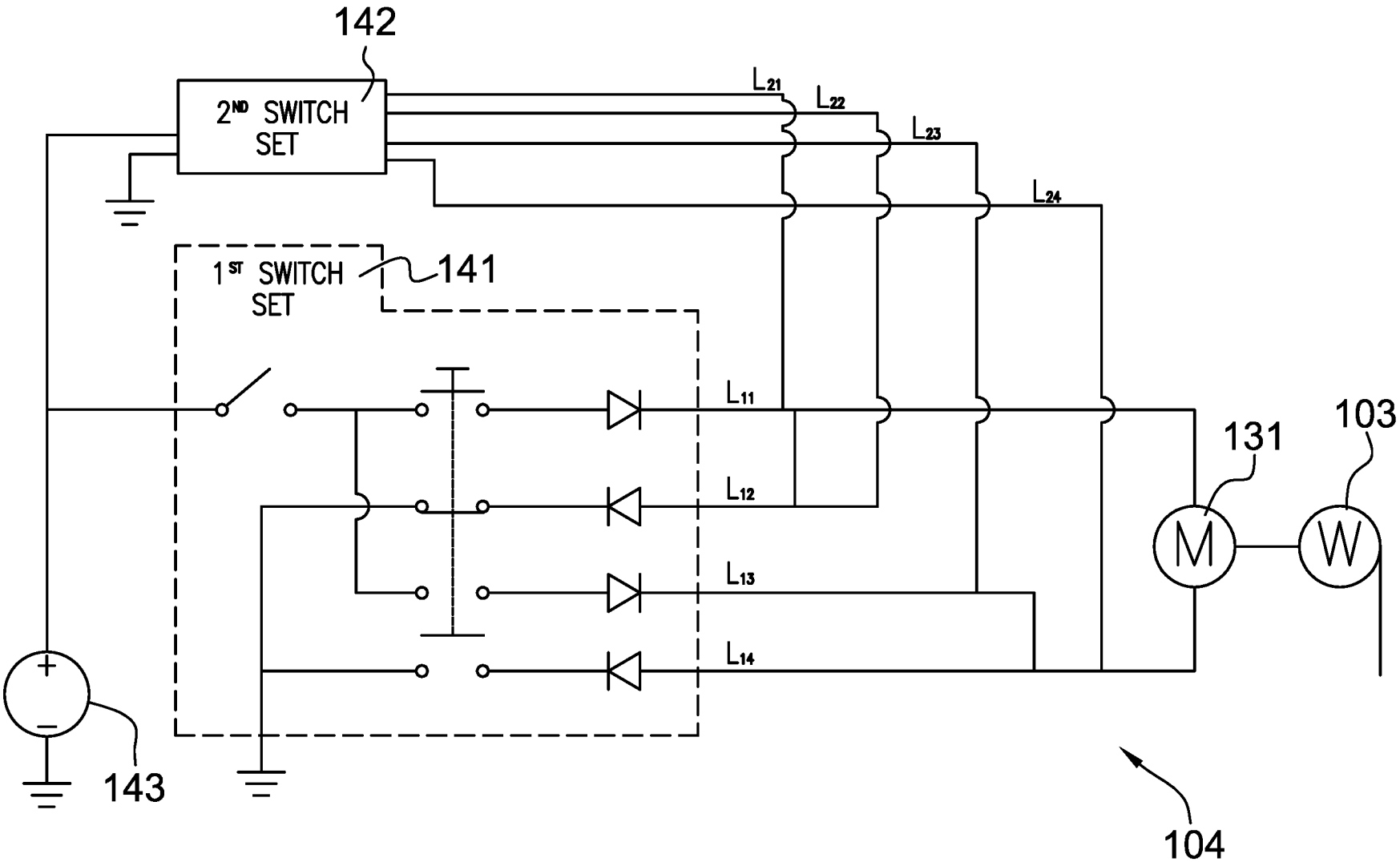
FIG. 5 is a schematic view of an embodiment of the disclosure.

Detailed reference will now be made to one or more potential embodiments of the disclosure, which are illustrated in FIGS. 1 through 5.

The portable transport apparatus 100 (hereinafter invention) is a mechanical structure. The invention 100 forms a ramp. The invention 100 is a portable structure. The invention 100 is a temporary structure. The invention 100 transports cargo 105 between a first horizontal surface 201 and a second horizontal surface 202. By unaligned is meant that the elevation of the first horizontal surface 201 is different from the elevation of the second horizontal surface 202. The invention 100 is an electrically powered device. The invention 100 converts electrical energy into mechanical energy used to change the elevation of the cargo 105 between the first horizontal surface 201 and the second horizontal surface 202. The cargo 105 is defined elsewhere in this disclosure.

The invention 100 comprises a plurality of pedestal structures 101, a track structure 102, a winch structure 103, and a control circuit 104. The track structure 102 interconnects the plurality of pedestal structures 101. The winch structure 103 mounts on the plurality of pedestal structures 101. The control circuit 104 mounts on the plurality of pedestal structures 101. The control circuit 104 controls the operation of the winch structure 103. The winch structure 103 provides the motive forces required to change the elevation of the cargo 105.

Each pedestal structure selected from the plurality of pedestal structures 101 forms a terminating structure that attaches to the track structure 102. Each selected pedestal structure physically secures the invention 100 to a horizontal surface selected from the group consisting of the first horizontal surface 201 and the second horizontal surface 202. The plurality of pedestal structures 101 comprises a first pedestal structure 111 and a second pedestal structure 112.

The first pedestal structure 111 is a terminating structure that attaches to a first congruent end 211 of the prism structure of the track structure 102. The first pedestal structure 111 removably secures the track structure 102 to a horizontal surface selected from the group consisting of the first horizontal surface 201 and the second horizontal surface 202. The first pedestal structure 111 comprises a first plate box 151, a first anchor structure 152, and a first winch mount 153.

The first plate box 151 is a prism shaped structure. The first plate box 151 is a rigid structure. The first plate box 151 is a hollow structure. The first plate box 151 forms a protected space that contains the first winch mount 153. The first anchor structure 152 mounts on the exterior surface of the first plate box 151. The first plate box 151 attaches to the first congruent end 211 of the supporting gusset 121. The first plate box 151 attaches to the supporting gusset 121 such that the center of the prism structure of the first plate box 151 aligns with the center axis of the prism structure of the supporting gusset 121.

The first anchor structure 152 is a fastening device. The first anchor structure 152 mounts on the exterior surface of the lateral face of the prism structure of the first plate box 151. The first anchor structure 152 removably secures the first plate box 151 to a horizontal surface selected from the group consisting of the first horizontal surface 201 and the second horizontal surface 202. The first anchor structure 152 maintains the first plate box 151 in a fixed position relative to the selected horizontal surface. In the first potential embodiment of the disclosure, the first anchor structure 152 comprise a first plurality of suction cups.

The first winch mount 153 is a negative space formed within the protected space formed by the first plate box 151. The first winch mount 153 contains the winch motor 131. The first winch mount 153 further contains the first active pulley 181 of the first lifting rig 171 and the second active pulley 191 of the second lifting rig 172.

The second pedestal structure 112 is a terminating structure that attaches to a first congruent end 211 of the prism structure of the track structure 102. The second pedestal structure 112 removably secures the track structure 102 to a horizontal surface selected from the group consisting of the first horizontal surface 201 and the second horizontal surface 202. The second pedestal structure 112 comprises a second plate box 161, a second anchor structure 162, and a second winch mount 163.

The second plate box 161 is a prism shaped structure. The second plate box 161 is a rigid structure. The second plate box 161 is a hollow structure. The second plate box 161 forms a protected space that contains the second winch mount 163. The second anchor structure 162 mounts on the exterior surface of the second plate box 161. The second plate box 161 attaches to the second congruent end 212 of the supporting gusset 121. The second plate box 161 attaches to the supporting gusset 121 such that the center of the prism structure of the second plate box 161 aligns with the center axis of the prism structure of the supporting gusset 121.

The second anchor structure 162 is a fastening device. The second anchor structure 162 mounts on the exterior surface of the lateral face of the prism structure of the second plate box 161. The second anchor structure 162 removably secures the second plate box 161 to a horizontal surface selected from the group consisting of the first horizontal surface 201 and the second horizontal surface 202. The second anchor structure 162 maintains the second plate box 161 in a fixed position relative to the selected horizontal surface. In the first potential embodiment of the disclosure, the second anchor structure 162 comprise a second plurality of suction cups.

The second winch mount 163 is a negative space formed within the protected space formed by the second plate box 161. The second winch mount 163 further contains the first reversing pulley 182 of the first lifting rig 171 and the second reversing pulley 192 of the second lifting rig 172.

The track structure 102 is a prism shaped structure. The track structure 102 is a rigid structure. The track structure 102 is a load bearing structure. The track structure 102 attaches the first pedestal structure 111 to the second pedestal structure 112. The track structure 102 is an extension structure that forms the reach between the first pedestal structure 111 and the second pedestal structure 112. The track structure 102 is an extensible structure. The track structure 102 forms a telescopic structure. The track structure 102 allows for the adjustment of the reach between the first pedestal structure 111 and the second pedestal structure 112. The track structure 102 forms a track that controls the direction of the motion of the cargo 105 during the transit between the first horizontal surface 201 and the second horizontal surface 202. The track structure 102 comprises a supporting gusset 121 and a lifting footer 122.

The supporting gusset 121 is a prism shaped structure. The supporting gusset 121 is a rigid structure. The supporting gusset 121 attaches the first pedestal structure 111 to the second pedestal structure 112. The supporting gusset 121 forms an extension structure that extends the reach between the first pedestal structure 111 and the second pedestal structure 112. The supporting gusset 121 forms an incline that bridges the difference in elevation between the first horizontal surface 201 and the second horizontal surface 202. In the first potential embodiment of the disclosure, the supporting gusset 121 is a telescopic structure. The telescopic structure of the supporting gusset 121 allows for the adjustment of the span of the length of the center axis of the prism structure of the supporting gusset 121.

The supporting gusset 121 comprises a first congruent end 211 and a second congruent end 212. The first congruent end 211 is a congruent end of the prism structure of the supporting gusset 121. The second congruent end 212 is a congruent end of the prism structure of the supporting gusset 121. The second congruent end 212 is the congruent end of the supporting gusset 121 that is distal from the first congruent end 211.

The lifting footer 122 is a prism shaped structure. The lifting footer 122 is a rigid structure. The lifting footer 122 attaches to the lateral face of the prism structure of the supporting gusset 121 such that the lifting footer 122 moves relative to the supporting gusset 121. The lifting footer 122 attaches to the supporting gusset 121 such that the center axis of the prism structure of the lifting footer 122 is perpendicular to the center axis of the prism structure of the supporting gusset 121. The lifting footer 122 forms a platform supports the load of the cargo 105 that is placed on the invention 100 for transport. The lifting footer 122 is a telescopic structure that adjusts to accommodate the form factor of the cargo 105. The telescopic structure of the lifting footer 122 allows for the adjustment of the span of the length of the center axis of the prism structure of the lifting footer 122.

The winch structure 103 is a mechanical structure. The winch structure 103 forms a winch. The winch structure 103 is an electrically powered device. The winch structure 103 generates and transfers the motive forces required to change, and control the change of, the elevation of the cargo 105 as it moves between the first horizontal surface 201 and the first horizontal surface 201. The components of the winch structure 103 are distributed between the first pedestal structure 111 of the plurality of pedestal structures 101 and the second pedestal structure 112 of the plurality of pedestal structures 101. The winch structure 103 comprises a winch motor 131 and a plurality of lifting rigs 132.

The winch motor 131 is an electric motor. The winch motor 131 mounts in the first winch mount 153 of the first pedestal structure 111 of the plurality of pedestal structures 101. The winch motor 131 converts electric energy into rotational energy. The winch motor 131 mechanically connects to the plurality of lifting rigs 132. The rotational energy generated by the winch motor 131 provides the motive forces used by the plurality of lifting rigs 132 to change the elevation of the cargo 105. The winch motor 131 electrically connects to the control circuit 104. The winch motor 131 draws electric energy from the control circuit 104.

Each lifting rig selected from the plurality of lifting rigs 132 is a mechanical structure. Each selected lifting rig is a load bearing structure. Each selected lifting rig attaches to the lifting footer 122 of the track structure 102. Each lifting rig selected from the plurality of lifting rigs 132 attaches to the winch motor 131. Each selected lifting rig converts the rotational energy received from the winch motor 131 into the motive forces the move the lifting footer 122 and the cargo 105 a direction parallel to the center axis of the prism structure of the supporting gusset 121. The plurality of lifting rigs 132 comprises a first lifting rig 171 and a second lifting rig 172.

The first lifting rig 171 is a lifting rig selected from the plurality of lifting rigs 132. The first lifting rig 171 receives rotational energy from the winch motor 131. The first lifting rig 171 forms a belt drive. The first lifting rig 171 converts the received rotational energy into the motive forces used to move the plurality of lifting rigs 132 into the motive forces necessary to move the lifting footer 122 and its associated cargo 105 relative to the supporting gusset 121. The first lifting rig 171 comprises a first active pulley 181, a first reversing pulley 182, and a first cable 183.

The first active pulley 181 is a pulley. The first active pulley 181 mounts within the first winch mount 153 of the first pedestal structure 111. The first active pulley 181 mechanically attaches to the winch motor 131 such that the rotation of the winch motor 131 rotates the first active pulley 181.

The first reversing pulley 182 is a pulley. The first reversing pulley 182 mounts within the first winch mount 153 of the first pedestal structure 111. The first reversing pulley 182 forms an idler that reverses the direction of the first cable 183.

The first cable 183 forms the belt of the belt drive formed by the first lifting rig 171. The first cable 183 forms a loop around the first active pulley 181 and the first reversing pulley 182. The first cable 183 physically attaches to the lifting footer 122. The rotation of the first active pulley 181 by the winch motor 131 rotates the first cable 183 around the first active pulley 181 and the first reversing pulley 182 such that the first cable 183 provides the motive forces necessary to move the lifting footer 122 relative to the supporting gusset 121.

The second lifting rig 172 is a lifting rig selected from the plurality of lifting rigs 132. The second lifting rig 172 receives rotational energy from the winch motor 131. The second lifting rig 172 converts the received rotational energy into the motive forces used to move the plurality of lifting rigs 132 into the motive forces necessary to move the lifting footer 122 and its associated cargo 105 relative to the supporting gusset 121. The second lifting rig 172 comprises a second active pulley 191, a second reversing pulley 192, and a second cable 193.

The second active pulley 191 is a pulley. The second active pulley 191 mounts within the second winch mount 163 of the second pedestal structure 112. The second active pulley 191 mechanically attaches to the winch motor 131 such that the rotation of the winch motor 131 rotates the second active pulley 191.

The second reversing pulley 192 is a pulley. The second reversing pulley 192 mounts within the second winch mount 163 of the second pedestal structure 112. The second reversing pulley 192 forms an idler that reverses the direction of the second cable 193.

The second cable 193 forms the belt of the belt drive formed by the second lifting rig 172. The second cable 193 forms a loop around the second active pulley 191 and the second reversing pulley 192. The second cable 193 physically attaches to the lifting footer 122. The rotation of the second active pulley 191 by the winch motor 131 rotates the second cable 193 around the second active pulley 191 and the second reversing pulley 192 such that the second cable 193 provides the motive forces necessary to move the lifting footer 122 relative to the supporting gusset 121.

The control circuit 104 is an electric circuit. The control circuit 104 controls the flow of electric energy into the winch structure 103. The control circuit 104 controls the operation of the winch structure 103 by controlling the electric energy that is made available to the winch motor 131 of the winch structure 103. The control circuit 104 controls the direction of rotation of the winch motor 131. The control circuit 104 controls the speed of rotation of the winch motor 131. The control circuit 104 comprises a first switch set 141, a second switch set 142, and an external power source 143. The first switch set 141, the second switch set 142, and the external power source 143 are electrically interconnected. The external power source 143 is an externally provided source of electric energy. The external power source 143 is defined elsewhere in this disclosure.

The first switch set 141 is a switching circuit. The first switch set 141 forms an electric connection between the external power source 143 and the winch motor 131. The first switch set 141 mounts on the first pedestal structure 111 of the plurality of pedestal structures 101. The first switch set 141 controls the flow of electric energy into the winch motor 131. The first switch set 141 controls the direction of rotation of the winch motor 131. The first switch set 141 controls the speed of rotation of the winch motor 131.

The second switch set 142 is a switching circuit. The second switch set 142 forms an electric connection between the external power source 143 and the winch motor 131. The second switch set 142 electrically connects to the first switch set 141. The operation of the second switch set 142 is electrically isolated from the first switch set 141. The second switch set 142 mounts on the second pedestal structure 112 of the plurality of pedestal structures 101. The second switch set 142 controls the flow of electric energy into the winch motor 131. The second switch set 142 controls the direction of rotation of the winch motor 131. The second switch set 142 controls the speed of rotation of the winch motor 131.

The switching circuit that forms the second switch set 142 is identical to the switching circuit that forms the first switch set 141.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Belt Drive: As used in this disclosure, the belt drive is a transmission. The belt drive comprises a belt, a drive pulley, one or more transfer pulleys, and a drive mechanism. The belt is threaded around that drive pulley and the one or more transfer pulleys to form a loop. The drive mechanism attaches to the drive pulley such that the rotation of the drive mechanism rotates the belt around the one or more transfer pulleys. The rotation of the belt around the one or more transfer pulleys transfers the rotational energy from the drive mechanism to the one or more transfer pulleys such that each of the one or more transfer pulleys can rotate a load attached to the transfer pulley. A transfer pulley that changes the direction of the track but does not rotate a load is called an idler pulley. A chain drive is a belt drive wherein: a) the belt is replaced by a chain; and each of the drive pulley; and, b) each of the one or more transfer pulleys is a gear structure.

Cant: As used in this disclosure, a cant is an angular deviation from one or more reference lines (or planes) such as a vertical line (or plane) or a horizontal line (or plane).

Cargo: As used in this disclosure, cargo refers to one or more objects that are intended to be transported using a mechanical device.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Collapsible: As used in this disclosure, the terms collapsible refers to an object that is configured such that the volume of the object is adjustable. By volume is meant the volume of the perimetrical boundary that contains the object. The verbs collapse and retract mean that the volume of the perimetrical boundary of the object changes from a larger volume to a smaller volume. The verbs expand and deploy mean that the volume of the perimetrical boundary of the object changes from a smaller volume to a larger volume.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extensible: As used in this disclosure, extensible is an adjective that describes an object made of sections that fit or together such that the object can be made longer or shorter by adjusting the relative positions of the sections.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gusset: As used in this disclosure, a gusset is an angled structural member used to form a portion of the load path of section of a framework. By angled is meant that the gusset is neither parallel nor perpendicular to the force of gravity.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Incline: As used in this disclosure, the term inclines is a term that refers to a cant that is formed between a first line or surface and a reference line or surface. The line or surface that is not the reference line or surface is the "inclined" line or surface.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Permanent: As used in this disclosure, the term permanent refers to a fundamental state, condition or location of an object, process, or arrangement that is not subject to, or expected to be, changed. A perpetual object refers to a permanent object that is expected to last over an unlimited period of time. A building such as a house or a skyscraper would be considered permanent. An ocean would be considered perpetual.

Pivot: As used in this disclosure, a pivot is a rod or shaft around which an object rotates or swings.

Portable: As used in this disclosure, the term portable refers to an object with a form factor and weight that allows for the manual transport the object to its intended destination.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains an environment suitable within the protected space that is appropriate for the object; or, c) protects the object within the protected space from potential dangers that are outside of the protected space.

Pulley: As used in this disclosure a pulley is a wheel with a grooved rim around which a cord (or other form of rope, line, or cable) passes. The pulley is used to change the direction of a force applied to the cord.

Ramp: As used in this disclosure, a ramp is an inclined structure that joins two parallel structures that are: 1) of different elevations; or 2) not aligned on the same plane or line.

Reach: As used in this disclosure, reach refers to a span of distance between any two objects.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Stairs: As used in this disclosure, stairs (also referred to as a set of stairs) are a structure formed from a plurality of steps. Each of the plurality of steps forms a horizontally oriented platform. The elevation of the platform of any first step contained in the plurality of steps is different from the elevation of the platform of any second step contained in the plurality of steps. The plurality of steps are sequenced such that the elevation of any two adjacent steps selected from the plurality of steps always increases for ascending the stairs (or equivalently always decreases for descending the stairs). The plurality of steps forms a series of load bearing platforms that allow the individual readily change their elevation by stepping onto each step in the proper sequence.

Step: As used in this disclosure, a step is a horizontally oriented platform on which an object rests. The step is used to increase or decrease the elevation of the object.

Suction Cup: As used in this disclosure, a suction cup means an object or device that uses negative fluid pressure of air or water to adhere to nonporous surfaces by creating a partial vacuum.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Switching Circuit: As used in this disclosure, a switching circuit is non-programmable electrical device that receives one or more digital or analog inputs and uses those digital or analog inputs to generate one or more digital or analog outputs.

Switching Element: This is a device that closes and opens an electrical circuit in response to an electrical control signal. Examples of switching elements include, but are not limited to, relays and transistors.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Temporary: As used in this disclosure, the term temporary refers to a state, condition or location of an object, process, or arrangement that is intended to last for a limited period of time. The term temporary is the opposite of permanent. The term transient refers to a temporary state or condition of an object that degrades over time. In physical processes, the term transient tends to imply a short period of time.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Winch: As used in this disclosure, a winch is a device that comprises a cord and a rotating spool. The cord is wound on the spool. The winch is used to move or lift an object by: 1) partially unwinding the cord from the rotating spool; 2) attaching the free end of the cord to the object to be moved or lifted; and, 3) winding the cord back on to the rotating spool in order to move or lift the object.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable transport apparatus comprising a plurality of pedestal structures, a track structure, a winch structure, and a control circuit;

wherein the track structure interconnects the plurality of pedestal structures;

wherein the winch structure mounts on the plurality of pedestal structures;

wherein the control circuit mounts on the plurality of pedestal structures;

wherein the control circuit controls the operation of the winch structure;

wherein the plurality of pedestal structures is further defined with a first pedestal structure and a second pedestal structure;

wherein the track structure comprises a supporting gusset and a lifting footer;

wherein the lifting footer attaches to the supporting gusset such that the lifting footer moves relative to the supporting gusset;

wherein a supporting gusset is a rigid structure;

wherein the supporting gusset attaches a first pedestal structure to a second pedestal structure;

wherein the supporting gusset forms an extension structure that extends the reach between the first pedestal structure and the second pedestal structure;

wherein the supporting gusset forms an incline that bridges the difference in elevation between the first horizontal surface and the second horizontal surface;

wherein the supporting gusset is a telescopic structure;

wherein the telescopic structure of the supporting gusset allows for the adjustment of the span of the length of the center axis of the supporting gusset;

wherein the supporting gusset comprises a first congruent end and a second congruent end;

wherein the first congruent end is a congruent end of the supporting gusset;

wherein the second congruent end is a congruent end of the supporting gusset;

wherein the second congruent end is the congruent end of the supporting gusset that is distal from the first congruent end.

2. The portable transport apparatus according to claim 1 wherein the portable transport apparatus is a mechanical structure;

wherein the portable transport apparatus forms a ramp;

wherein the portable transport apparatus is a portable structure;

wherein the portable transport apparatus is a temporary structure;

wherein the portable transport apparatus transports cargo between a first horizontal surface and a second horizontal surface;

wherein by unaligned is meant that the elevation of the first horizontal surface is different from the elevation of the second horizontal surface;

wherein the winch structure provides the motive forces required to change the elevation of the cargo;

wherein the portable transport apparatus is an electrically powered device;

wherein the portable transport apparatus converts electrical energy into mechanical energy used to change the elevation of the cargo between the first horizontal surface and the second horizontal surface.

3. The portable transport apparatus according to claim 2 wherein each pedestal structure selected from the plurality of pedestal structures forms a terminating structure that attaches to the track structure;

wherein each selected pedestal structure physically secures the portable transport apparatus to a horizontal surface selected from the group consisting of the first horizontal surface and the second horizontal surface.

4. The portable transport apparatus according to claim 3 wherein the track structure is a rigid structure;

wherein the track structure is a load bearing structure;

wherein the track structure attaches the first pedestal structure to the second pedestal structure;

wherein the track structure is an extension structure that forms the reach between the first pedestal structure and the second pedestal structure;

wherein the track structure is an extensible structure;

wherein the track structure forms a telescopic structure;

wherein the track structure allows for the adjustment of the reach between the first pedestal structure and the second pedestal structure;

wherein the track structure forms a track that controls the direction of the motion of the cargo during the transit between the first horizontal surface and the second horizontal surface.

5. The portable transport apparatus according to claim 4 wherein the winch structure is a mechanical structure;

wherein the winch structure forms a winch;

wherein the winch structure is an electrically powered device;

wherein the winch structure generates and transfers the motive forces required to change, and control the change of, the elevation of the cargo as it moves between the first horizontal surface and the first horizontal surface;

wherein the winch structure generates and transfers the motive forces required to control the change of the elevation of the cargo as it moves between a first horizontal surface and a first horizontal surface.

6. The portable transport apparatus according to claim 5 wherein the control circuit is an electric circuit;

wherein the control circuit controls the flow of electric energy into the winch structure;

wherein the control circuit controls the operation of the winch structure by controlling the electric energy that is made available to the winch structure;

wherein the control circuit controls the direction of rotation of the winch structure;

wherein the control circuit controls the speed of rotation of the winch structure.

7. The portable transport apparatus according to claim 6 wherein the plurality of pedestal structures comprises a first pedestal structure and a second pedestal structure;

wherein the first pedestal structure is a terminating structure that attaches to a first congruent end of the track structure;

wherein the first pedestal structure removably secures the track structure to a horizontal surface selected from the group consisting of the first horizontal surface and the second horizontal surface;

wherein the second pedestal structure is a terminating structure that attaches to a first congruent end of the track structure;

wherein the second pedestal structure removably secures the track structure to a horizontal surface selected from the group consisting of the first horizontal surface and the second horizontal surface.

8. The portable transport apparatus according to claim 7 wherein the winch structure comprises a winch motor and a plurality of lifting rigs;

wherein the winch motor mechanically connects to the plurality of lifting rigs.

9. The portable transport apparatus according to claim 8 wherein the control circuit comprises a first switch set, a second switch set, and an external power source;

wherein the first switch set, the second switch set, and the external power source are electrically interconnected;

wherein the external power source is a source of electric energy.

10. The portable transport apparatus according to claim 9 wherein the first pedestal structure comprises a first plate box, a first anchor structure, and a first winch mount;

wherein the first plate box is a rigid structure;

wherein the first plate box is a hollow structure;

wherein the first plate box forms a protected space that contains the first winch mount;

wherein the first anchor structure mounts on the exterior surface of the first plate box;

wherein the first plate box attaches to the first congruent end of the supporting gusset;

wherein the first plate box attaches to the supporting gusset such that the center of the first plate box aligns with the center axis of the supporting gusset;

wherein the first anchor structure is a fastening device;

wherein the first anchor structure mounts on the exterior surface of the lateral face of the first plate box;

wherein the first anchor structure removably secures the first plate box to a horizontal surface selected from the group consisting of the first horizontal surface and the second horizontal surface;

wherein the first anchor structure maintains the first plate box in a fixed position relative to the selected horizontal surface;

wherein the first winch mount is a negative space formed within the protected space formed by the first plate box;

wherein the first winch mount contains the winch motor.

11. The portable transport apparatus according to claim 10 wherein the second pedestal structure comprises a second plate box, a second anchor structure, and a second winch mount;

wherein the second plate box is a rigid structure;

wherein the second plate box is a hollow structure;

wherein the second plate box forms a protected space that contains the second winch mount;

wherein the second anchor structure mounts on the exterior surface of the second plate box;

wherein the second plate box attaches to the second congruent end of the supporting gusset;

wherein the second plate box attaches to the supporting gusset such that the center of the second plate box aligns with the center axis of the supporting gusset;

wherein the second anchor structure is a fastening device;

wherein the second anchor structure mounts on the exterior surface of the lateral face of the second plate box;

wherein the second anchor structure removably secures the second plate box to a horizontal surface selected from the group consisting of the first horizontal surface and the second horizontal surface;

wherein the second anchor structure maintains the second plate box in a fixed position relative to the selected horizontal surface;

wherein the second winch mount is a negative space formed within the protected space formed by the second plate box.

12. The portable transport apparatus according to claim 11 wherein the lifting footer is a rigid structure;

wherein the lifting footer attaches to the lateral face of the supporting gusset such that the lifting footer moves relative to the supporting gusset;

wherein the lifting footer attaches to the supporting gusset such that the center axis of the lifting footer is perpendicular to the center axis of the supporting gusset;

wherein the lifting footer forms a platform supports the load of the cargo that is placed on the portable transport apparatus for transport.

13. The portable transport apparatus according to claim 12 wherein the winch motor is an electric motor;

wherein the winch motor mounts in the first winch mount of the first pedestal structure of the plurality of pedestal structures;

wherein the winch motor converts electric energy into rotational energy;

wherein the rotational energy generated by the winch motor provides the motive forces used by the plurality of lifting rigs to change the elevation of the cargo;

wherein the winch motor electrically connects to the control circuit;

wherein the winch motor draws electric energy from the control circuit.

14. The portable transport apparatus according to claim 13 wherein each lifting rig selected from the plurality of lifting rigs is a mechanical structure;

wherein each selected lifting rig is a load bearing structure;

wherein each selected lifting rig attaches to the lifting footer of the track structure;

wherein each lifting rig selected from the plurality of lifting rigs attaches to the winch motor;

wherein each selected lifting rig converts the rotational energy received from the winch motor into the motive forces the move the lifting footer and the cargo a direction parallel to the center axis of the supporting gusset.

15. The portable transport apparatus according to claim 14 wherein the plurality of lifting rigs comprises a first lifting rig and a second lifting rig;

wherein the first lifting rig is a lifting rig selected from the plurality of lifting rigs;

wherein the first lifting rig receives rotational energy from the winch motor;

wherein the first lifting rig forms a belt drive;

wherein the first lifting rig converts the received rotational energy into the motive forces used to move the plurality of lifting rigs into the motive forces necessary to move the lifting footer and its associated cargo relative to the supporting gusset;

wherein the second lifting rig is a lifting rig selected from the plurality of lifting rigs;

wherein the second lifting rig receives rotational energy from the winch motor;

wherein the second lifting rig converts the received rotational energy into the motive forces used to move the plurality of lifting rigs into the motive forces necessary to move the lifting footer and its associated cargo relative to the supporting gusset.

16. The portable transport apparatus according to claim 15 wherein the first lifting rig comprises a first active pulley, a first reversing pulley, and a first cable;

wherein the first active pulley is a pulley;

wherein the first active pulley mounts within the first winch mount of the first pedestal structure;

wherein the first active pulley mechanically attaches to the winch motor such that the rotation of the winch motor rotates the first active pulley;

wherein the first reversing pulley is a pulley;

wherein the first reversing pulley mounts within the first winch mount of the first pedestal structure;

wherein the first reversing pulley forms an idler that reverses the direction of the first cable;

wherein the first cable forms the belt of the belt drive formed by the first lifting rig;

wherein the first cable forms a loop around the first active pulley and the first reversing pulley;

wherein the first cable physically attaches to the lifting footer;

wherein the second lifting rig comprises a second active pulley, a second reversing pulley, and a second cable;

wherein the second active pulley is a pulley;

wherein the second active pulley mounts within the second winch mount of the second pedestal structure;

wherein the second active pulley mechanically attaches to the winch motor such that the rotation of the winch motor rotates the second active pulley;

wherein the second reversing pulley is a pulley;

wherein the second reversing pulley mounts within the second winch mount of the second pedestal structure;

wherein the second reversing pulley forms an idler that reverses the direction of the second cable;

wherein the second cable forms the belt of the belt drive formed by the second lifting rig;

wherein the second cable forms a loop around the second active pulley and the second reversing pulley;

wherein the second cable physically attaches to the lifting footer.

17. The portable transport apparatus according to claim 16 wherein the first switch set is a switching circuit;

wherein the first switch set forms an electric connection between the external power source and the winch motor;

wherein the first switch set mounts on the first pedestal structure of the plurality of pedestal structures;

wherein the first switch set controls the flow of electric energy into the winch motor;

wherein the first switch set controls the direction of rotation of the winch motor;

wherein the first switch set controls the speed of rotation of the winch motor;

wherein the second switch set is a switching circuit;

wherein the second switch set forms an electric connection between the external power source and the winch motor;

wherein the second switch set electrically connects to the first switch set;

wherein the operation of the second switch set is electrically isolated from the first switch set;

wherein the second switch set mounts on the second pedestal structure of the plurality of pedestal structures;

wherein the second switch set controls the flow of electric energy into the winch motor;

wherein the second switch set controls the direction of rotation of the winch motor;

wherein the second switch set controls the speed of rotation of the winch motor;

wherein the switching circuit that forms the second switch set is identical to the switching circuit that forms the first switch set.

* * * * *